US006513352B1

(12) United States Patent
Mainville

(10) Patent No.: US 6,513,352 B1
(45) Date of Patent: Feb. 4, 2003

(54) SECURE STORAGE SYSTEM FOR CREMATION URNS

(75) Inventor: Patrick Mainville, Montreal (CA)

(73) Assignee: Memorialization Systems of America, Rouyn-Noranda (CA)

( * ) Notice: Subject to any disclaimer, the term of this patent is extended or adjusted under 35 U.S.C. 154(b) by 0 days.

(21) Appl. No.: 09/698,466

(22) Filed: Oct. 27, 2000

(51) Int. Cl.[7] ..... A61G 17/00; B65D 55/14

(52) U.S. Cl. ..... 70/166; 27/35; 52/139; 70/169; 292/83; 292/107

(58) Field of Search ..... 27/1, 35; 52/139; 292/83, 107; 70/163, 166–173

(56) References Cited

U.S. PATENT DOCUMENTS

| | | | | |
|---|---|---|---|---|
| 126,892 | A | * | 5/1872 | Mayo |
| 307,253 | A | * | 10/1884 | Armstrong |
| 370,276 | A | * | 9/1887 | Mooney |
| 823,709 | A | * | 6/1906 | Stevenson |
| 832,284 | A | * | 10/1906 | White |
| 993,954 | A | * | 5/1911 | Budlong |
| 1,700,801 | A | * | 2/1929 | Kipp |
| 1,797,527 | A | * | 3/1931 | King |
| 1,854,576 | A | * | 4/1932 | Blue |
| 2,205,110 | A | * | 6/1940 | Stone |
| 3,522,963 | A | * | 8/1970 | Farnden ..... 292/83 |
| 3,841,518 | A | * | 10/1974 | Hines ..... 292/83 X |
| 4,199,848 | A | | 4/1980 | Kohnert ..... 27/1 |
| 4,607,417 | A | | 8/1986 | Hancovsky ..... 27/1 |
| 4,644,711 | A | * | 2/1987 | Eickhof ..... 52/136 X |
| 5,172,457 | A | | 12/1992 | Allen et al. ..... 27/1 |
| 5,477,594 | A | | 12/1995 | Lepage ..... 27/1 |
| 5,625,933 | A | | 5/1997 | Neuberger et al. ..... 27/1 |
| 5,709,441 | A | | 1/1998 | Bartling et al. ..... 312/107 |
| 6,044,532 | A | | 4/2000 | Bowling et al. ..... 27/1 |

FOREIGN PATENT DOCUMENTS

| | | | | |
|---|---|---|---|---|
| GB | 2080396 | * | 2/1982 | ..... 292/83 |

* cited by examiner

*Primary Examiner*—Lloyd A. Gall
(74) *Attorney, Agent, or Firm*—Collard & Roe, P.C.

(57) ABSTRACT

A locking mechanism for locking a cremation urn inside a columbarium chamber or to another appropriate wall surface and a hidden lock for a funeral chamber shutter system are disclosed. The locking mechanism includes a male locking member which is rigidly securable to a wall surface, and a female receiving member in one of the top walls, bottom walls and sidewalls of the cremation urn. The female receiving member is securely interlockable with the male locking member. The locking mechanism also includes fastening means for securing the male locking member to the wall surface.

15 Claims, 9 Drawing Sheets

SECURE STORAGE SYSTEM FOR CREMATION URNS

FIELD OF THE INVENTION

The present invention relates to the storage of cremation urns and more particularly concerns security mechanisms for preventing the unauthorized removal of the urns from their storage location.

BACKGROUND

The ashes of deceased individuals are generally kept in cremation urns, which are themselves stored in a columbarium. Columbaria usually have a plurality of niches each adapted to receive one or two cremation urns, and each niche has an access opening in the front closed by a shutter panel. A columbarium can be installed indoors or outdoors. Due to the solemn nature of these installations, it is desirable that the columbarium and its components be of a subdued design. Usually, the walls of a columbarium are made of granite or marble and the shutter panels are formed in flat slabs of the same materials.

Vandalism of columbaria and theft of cremation urns are problems often encountered in the field, causing distress to the families of the deceased. A measure used to prevent theft of the cremation urns is to lock the urns themselves inside the columbarium niches. It is known in the art to use screws or glue for this purpose, but the result can be unsightly and ineffective. There is therefore a need for a hidden and efficient locking mechanism for locking a cremation urn inside a columbarium chamber or to any other structure in which it is stored or displayed.

Additionally, a further security feature used in the field is to prevent the shutter panels of the columbarium niche from being opened without authorization. Unsightly locks installed on the columbarium niches are however to be avoided. The same problem is encountered in the field of mausaleum chambers used to store caskets, which may be built along a design similar to columbarium niches. It is known in the art to lock the shutter panels with tamper-resistant hardware, but again, these measures are not always effective and can be aesthetically displeasing. There is therefore a need for a discreet yet effective locking mechanism for the shutter panels of a funeral chamber.

OBJECTS AND SUMMARY OF THE INVENTION

It is an object of the present invention to provide a storage system for funeral remains that prevents the theft of the same.

It is a more particular object of the invention to provide a discreet locking mechanism for locking a cremation urn inside a columbarium chamber or to another appropriate wall surface.

It is another object of the invention to provide a hidden lock on a shutter system of a funeral chamber.

According to a first aspect of the present invention, there is provided a locking mechanism for locking a cremation urn to a wall surface, the cremation urn itself having a top wall, a bottom wall and at least one sidewall.

The locking mechanism includes a male locking member which is rigidly securable to the wall surface, and a female receiving member in one of the top wall, bottom wall and sidewall of the cremation urn. The female receiving member is securely interlockable with the male locking member. The locking mechanism also includes fastening means for securing the male locking member to the wall surface.

In addition, in accordance with a second aspect of the present invention, there is provided a shutter system for a funeral chamber, such as a columbarium niche or a mausaleum chamber. The funeral chamber has a rim outlining a substantially rectangular front opening, this rim including two pairs of opposite sides.

The shutter system includes a shutter panel for covering the front opening. The panel has a front face, a back face and two pairs of opposite edges. Mounting means are provided for mounting the shutter panel to the funeral chamber, and include both a frame connected to the back face of the shutter panel, and a hooking member connected to this frame. The hooking member projects away from the back face of the shutter panel and is proximate to one of the edges of the shutter panel. The hooking member also extends in a plane generally perpendicular to the back face and generally parallel to one of the edges of the shutter panel.

The shutter system also includes a resilient member affixable to one of the sides of the rim and protruding outwardly from the same once affixed. The resilient member is engageable with the hooking member of the frame.

A key shaped to disengage the hooking member from the resilient member is finally provided.

The present invention and its advantages will be better understood upon reading the following non-restrictive description of embodiments thereof with reference to the accompanying drawings.

DESCRIPTION OF PREFERRED EMBODIMENTS OF THE INVENTION

The present invention offers a secure storage system for funeral remains, to prevent vandalism and theft thereof. The present invention includes two main aspects, that is, a locking mechanism for cremation urns inside a columbarium niche or attached to any other appropriate wall surface, and a shutter system for preventing the opening of funeral chamber such as a columbarium niche, a mausaleum chamber or the like.

Description of the Locking Mechanism for a Cremation Urn

In accordance with a first aspect of the invention and with reference to FIGS. 1, 2A, 2B and 2C, there is provided a locking mechanism 10 for locking a cremation urn 12 to a wall surface. In the illustrated embodiment, the wall surface is a bottom wall 14 of a columbarium niche 16 (see FIG. 4), however, it is understood that the cremation urn 12 could be locked to any other wall of the columbarium niche or to another structure, such as for example, a pedestal, without departing from the scope of the invention.

Figure 2A:
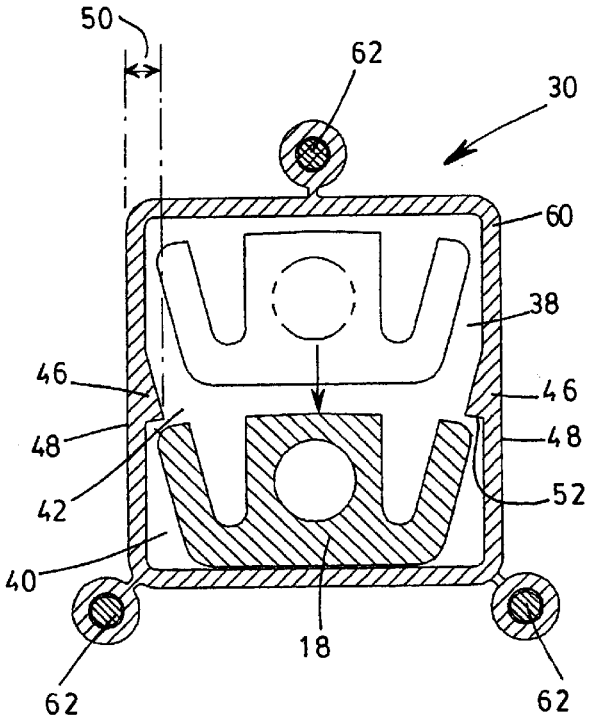
FIG. 2A is a cross-sectional view of the positioning of a connector inside the female receiving member according to a first embodiment of the invention.
Figure 2B:
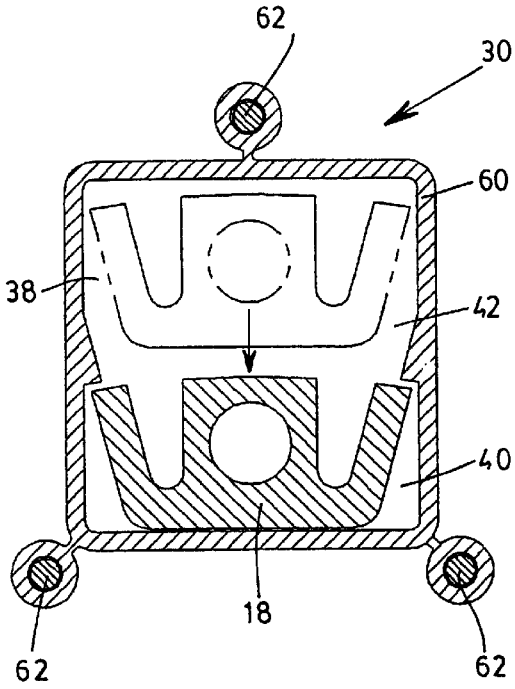
FIG. 2B is a cross-sectional view of the positioning of a connector inside the female receiving member according to a second embodiment of the invention.
Figure 2C:
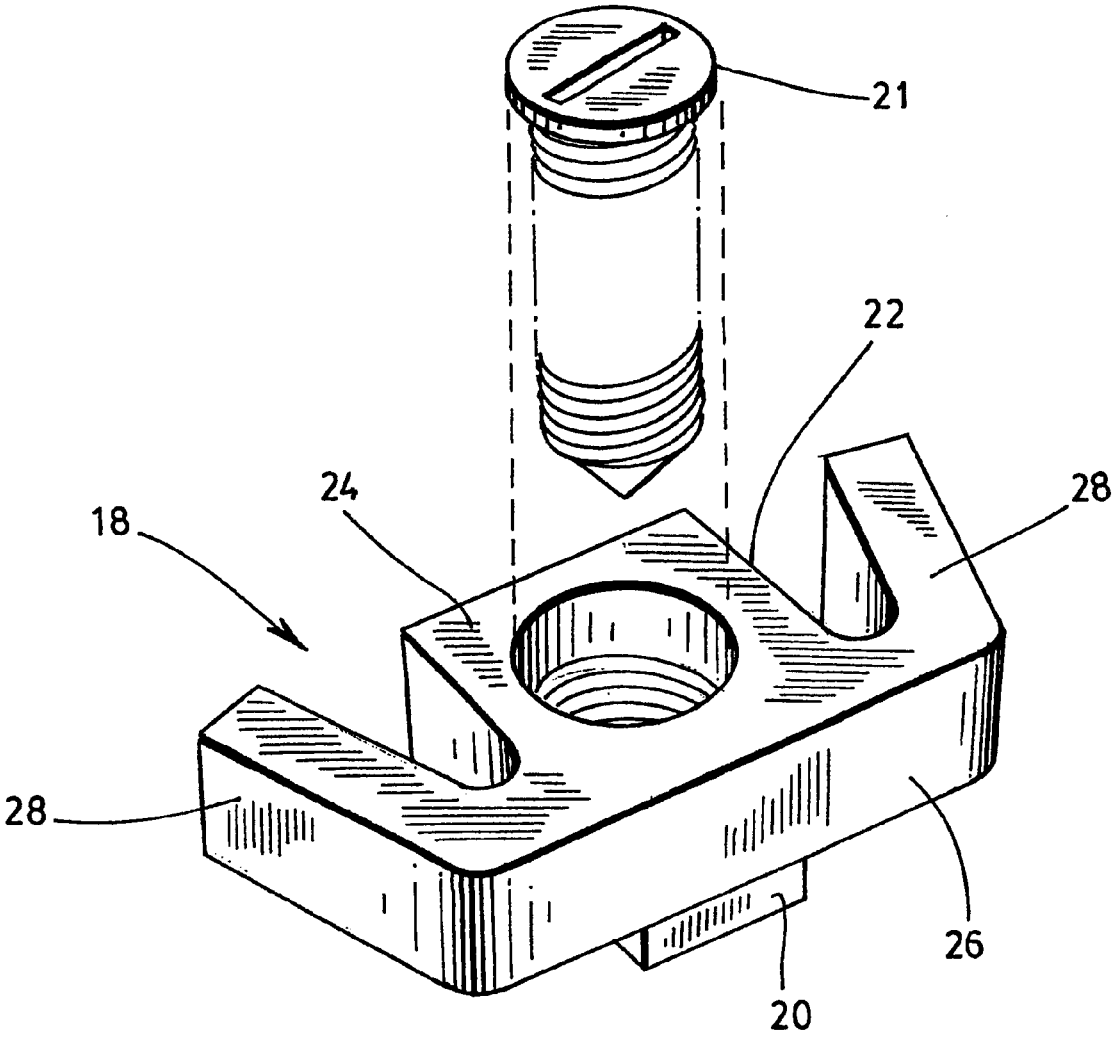
FIG. 2C is a perspective view of a male locking member as shown in FIG. 2B.

Referring to FIG. 2C, the locking mechanism first includes a male locking member 18 which, when installed, is rigidly secured to the bottom wall 14. Fasteners are provided for this purpose, such as, for example, a screw. Preferably the male locking member 18 has two main parts, a base 20 securable to the wall surface and a connector 22 topping the base 20. Means to secure the base 20 to the wall surface, such as a screw 21 or a rivet are provided. The connector 22 preferably has a generally rectangular body portion 24 and a resilient portion 26 having a pair of resilient arms 28 generally extending along opposite sides of the body portion 24.

Figure 1:
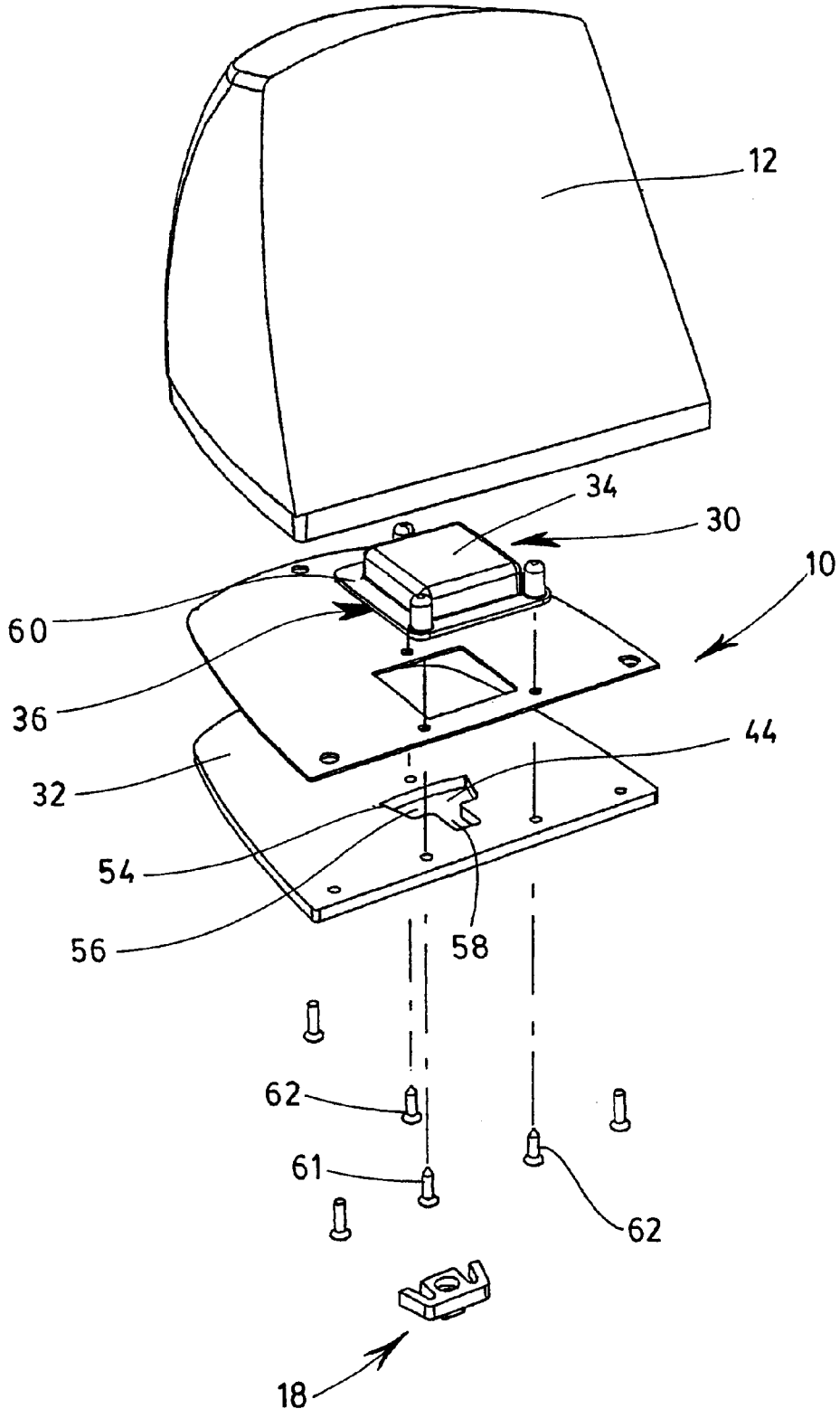
FIG. 1 is an exploded view of a cremation urn provided with a locking mechanism according to an embodiment of the invention.

Referring to FIGS. 1, 2A and 2B, the locking mechanism 10 also includes a female receiving member 30 in one of the walls of the cremation urn 12. In the preferred embodiment, the female receiving member 30 includes a rectangular-shaped box 34 having an open face 36 and which, when installed, is mounted inside the bottom wall 32 of the cremation urn 12 with its open face down. In the illustrated embodiment, a collar 60 extends around the open face 36 of the rectangular-shaped box 34, and, once installed, is rigidly connected to the bottom wall 32 of the cremation urn 12. Screws 62 may for example be provided for this purpose. The female receiving member 30 is securely interlockable with the male locking member 18, in the manner explained below.

The female receiving member preferably includes a first chamber 38, a second chamber 40 and a passage 42 therebetween, all of which are preferably included inside the rectangular-shaped box 34. The first chamber 38 has an entryway 44 for receiving the connector 22 of the male locking member 18. The connector 22 may then be slid through the passage 42 to the second chamber 40, which holds it in place. To this effect, the passage 42 preferably narrows progressively towards the second chamber 40, which compresses the two resilient arms 28 inwards towards the body 24 of the connector 22 when it is slid through the passage 42. The arms 28 then substantially return to their original shape once in the second chamber 40, which locks the connector 22 therein. As may be seen on FIGS. 2A and 2B, a pair of aligned flanges 46 are preferably disposed on opposed sides 48 of the passage 42. Each flange 46 has a width 50 increasing from the first to the second chamber 38 and 40, so as to define the progressive narrowing of said 30 passage 42, and forms a shoulder 52 in the second chamber 40 for engaging the arms 28 of the connector 22, once in the second chamber 40.

To prevent the connector 22 from being removed perpendicularly from the second chamber 40, the female receiving member 30 preferably includes an opening 54 in the bottom wall 32 of the cremation urn 12, having a first and a second section 56 and 58. The first section 56 is shaped to receive the connector 22 therethrough, and is aligned with the first chamber 38 when the box 34 is mounted in the cremation urn 12. The first section 56 thereby defines the entryway 44 of the first chamber 38. The second section 58 is aligned with the passage 42 and the second chamber 40, and is shaped to allow the base 20 of the male locking member 18 to protrude therethrough when the connector 22 is slid from the first to the second chamber 38 and 40. In this manner, the connector 22 is effectively held inside the second chamber 40.

In accordance with a first embodiment of the invention disclosed in FIG. 2A, the male locking member 18 may be releasable from the second chamber 40 by turning the cremation urn in a specific manner. For this purpose, the bottom ends of the arms 28 are rounded, allowing them to disengage from the shoulders 52. In a second embodiment, shown in FIG. 2B, the ends of the arms 28 are rectangular-shaped so that the male locking member cannot be disengaged from the female receiving member 30.

Figure 3B:
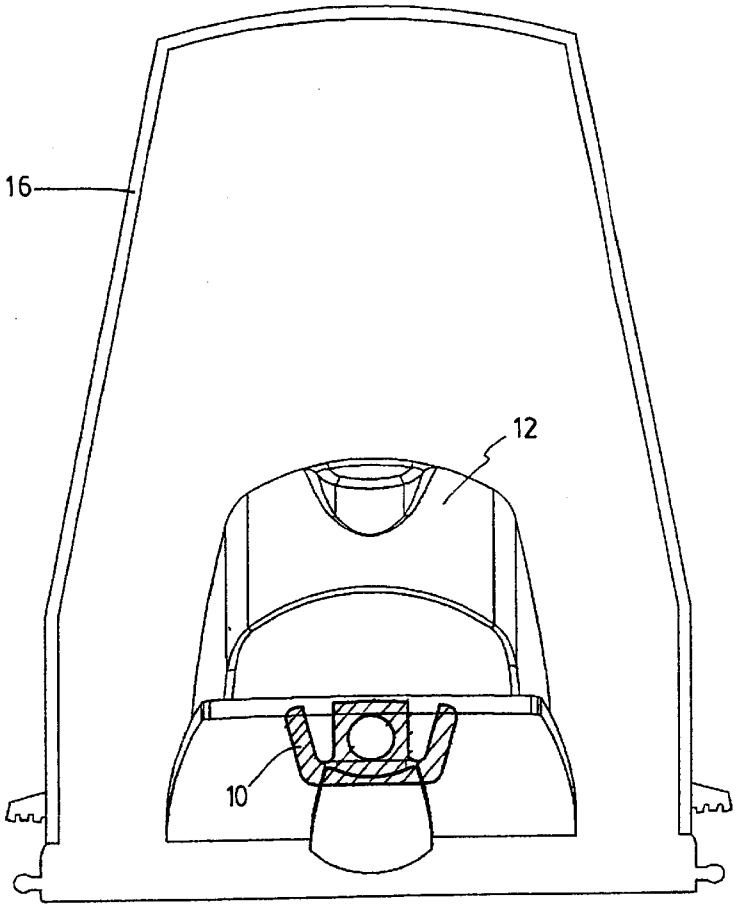
FIG. 3B is a top and partially transparent view of a columbarium niche having one cremation urn stored herein.
Figure 3A:
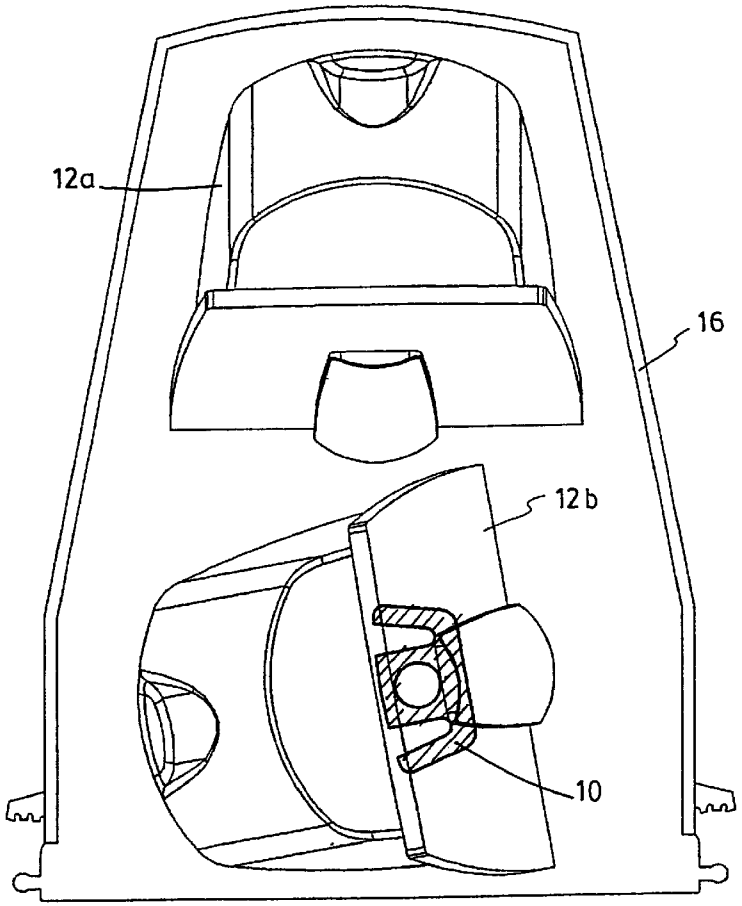
FIG. 3A is a top and partially transparent view of a columbarium niche having two cremation urns stored therein.

Of course, more than one locking mechanism may be installed inside a single columbarium niche 16. FIG. 3A illustrates the possible positioning of two locking mechanisms 10 inside a niche 16, for holding two cremation urns 12. In this embodiment, the cremation urn 12*a* in the back of the columbarium niche 16 does not need to be locked down, since the front urn 12*b* blocks access to it. Therefore, a single locking mechanism 10 is installed in the front of the niche 16 offset from the center thereof, so that the front cremation urn 12*b* may be installed sideways. Alternatively, the single mechanism 10 may be disposed centred in the front to receive a single cremation urn 12, as shown in FIG. 3B. As previously mentioned, it should be understood that the present invention is not limited for use in columbarium niches but may be used to lock a cremation urn to any appropriate wall surface. Additionally, another advantage of the locking mechanism according to the invention is that the male locking member may be of a small enough size not to interfere with the storage of other types of cremation urns in the columbarium niche.

Description of a Shutter System for a Columbarium Niche

In accordance with a second aspect of the invention, and with reference to FIGS. 4, 5A to 5D, 6 and 7, there is also provided a shutter system 100 for a columbarium niche 16. It is understood that the shutter system may be installed on a mausaleum chamber used for the storage of caskets, and that a columbarium niche is illustrated and described herein by way of example. For the purposes of the present invention, it is considered that the columbarium niche 16 has a rim 102 with two pairs of opposite sides, outlining a substantially rectangular front opening 104.

Figure 6:
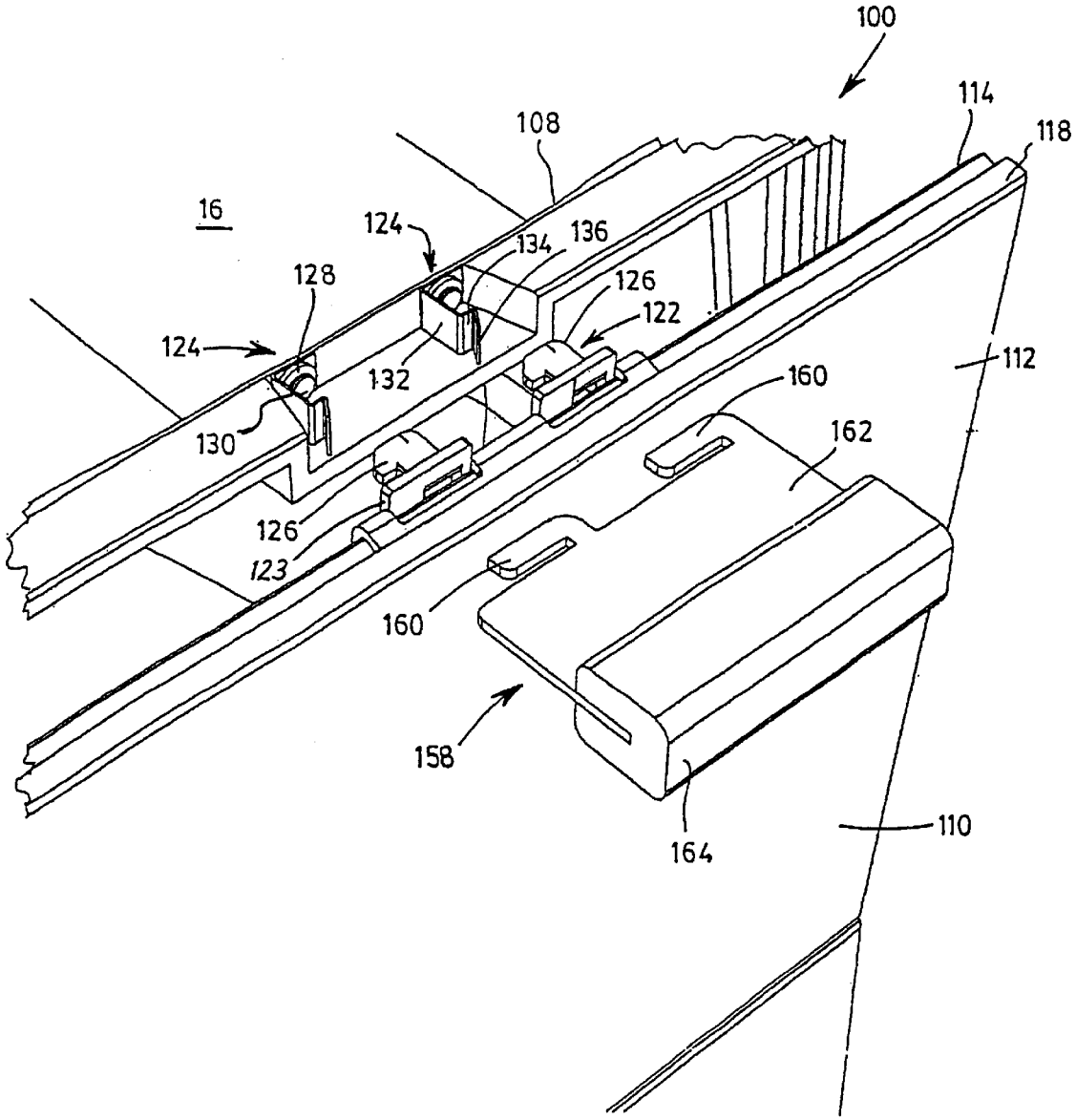
FIG. 6 is a perspective view showing a shutter system according to a preferred embodiment of the invention, when open.

The shutter system includes a shutter panel 110 having a front face 112, a back face 114 and two pairs of opposite edges. The shutter panel 110 is mountable to the columbarium niche 16, so that it covers the front opening 104 as shown in FIG. 6. Means for mounting the shutter panel 110 on the columbarium niche 16 are provided, and may be embodied as follows.

Figure 5A:
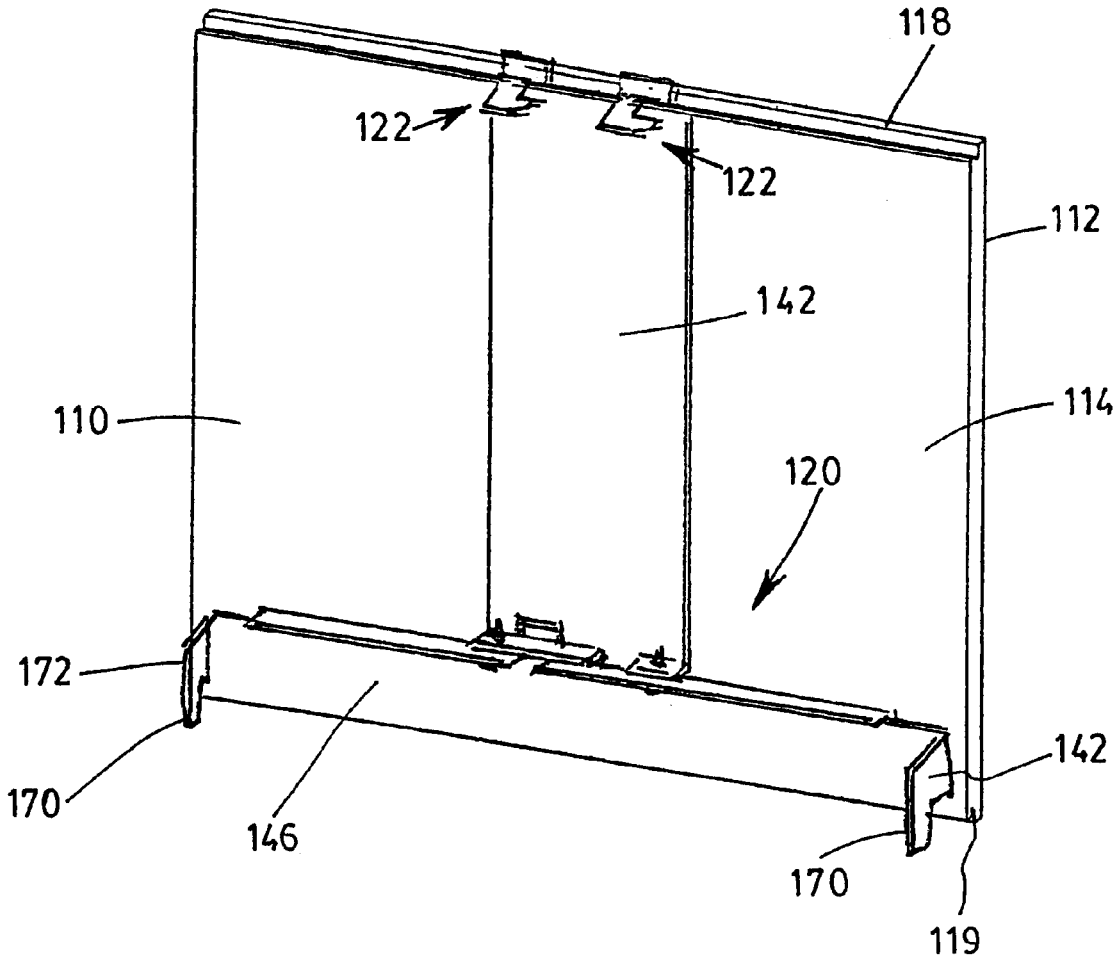
FIG. 5A is a perspective view of a shutter panel provided with mounting means for mounting the same to a columbarium niche according to a preferred embodiment of the invention.
Figures 5B, 5C, 5D:
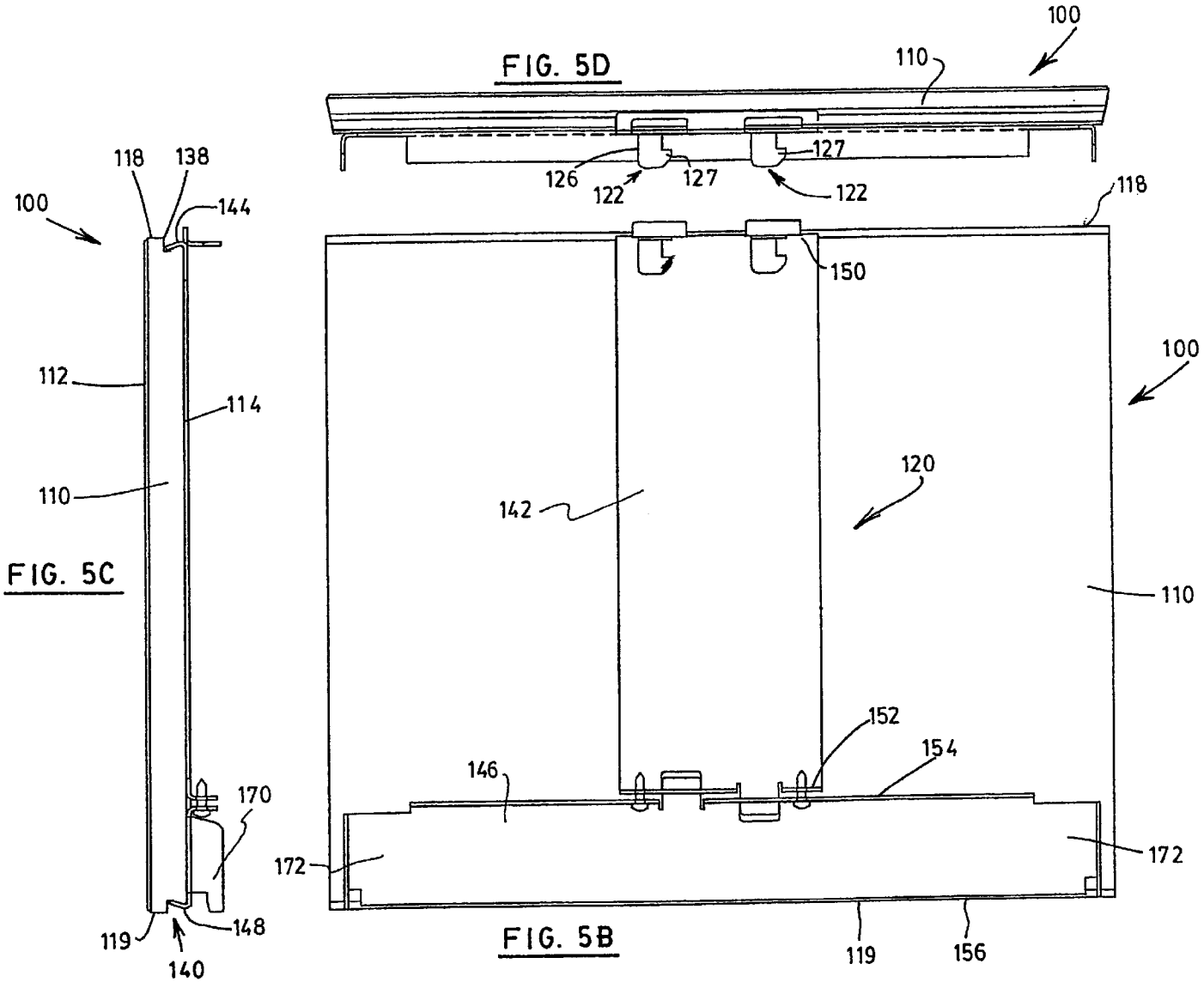
FIG. 5B is a back view of the shutter panel of FIG. 5A.
FIG. 5C is a side view of the shutter panel of FIG. 5A.
FIG. 5D is a top view of the same.

The back face 114 of the panel 110 preferably has a first groove 138 along its top edge 118 and a second groove 140 along its bottom edge 119. Each groove may be formed by inwardly bevelling the corresponding edge or be made inside the back face 114 slightly offset from the edge. A frame 120 is also provided, including a first bracket 142 with a tab 144 insertable in the first groove 138 and a second bracket 146 with a tab 148 insertable in the second groove 140. Both brackets 142 and 146 are preferably made of metal. The first bracket 142 preferably extends longitudinally on the back face 114 of the panel 110 from its top edge 118 towards its bottom edge 119, and has a top end 150 provided with the tab 144 and a bottom end 152 connectable to the second bracket 146. The second bracket 146 extends transversally along the bottom edge 119 of the panel 110. It has a top end 154 connectable with the bottom end 152 of the first bracket 142, and a bottom end 156 provided with the tab 148. Connecting means such as nuts and bolts are provided for removably connecting the first bracket 142 to the second bracket 146 and bringing them closer to clamp the panel 110 between the two tabs 144 and 148, as best shown in FIG. 5C.

Figure 4:
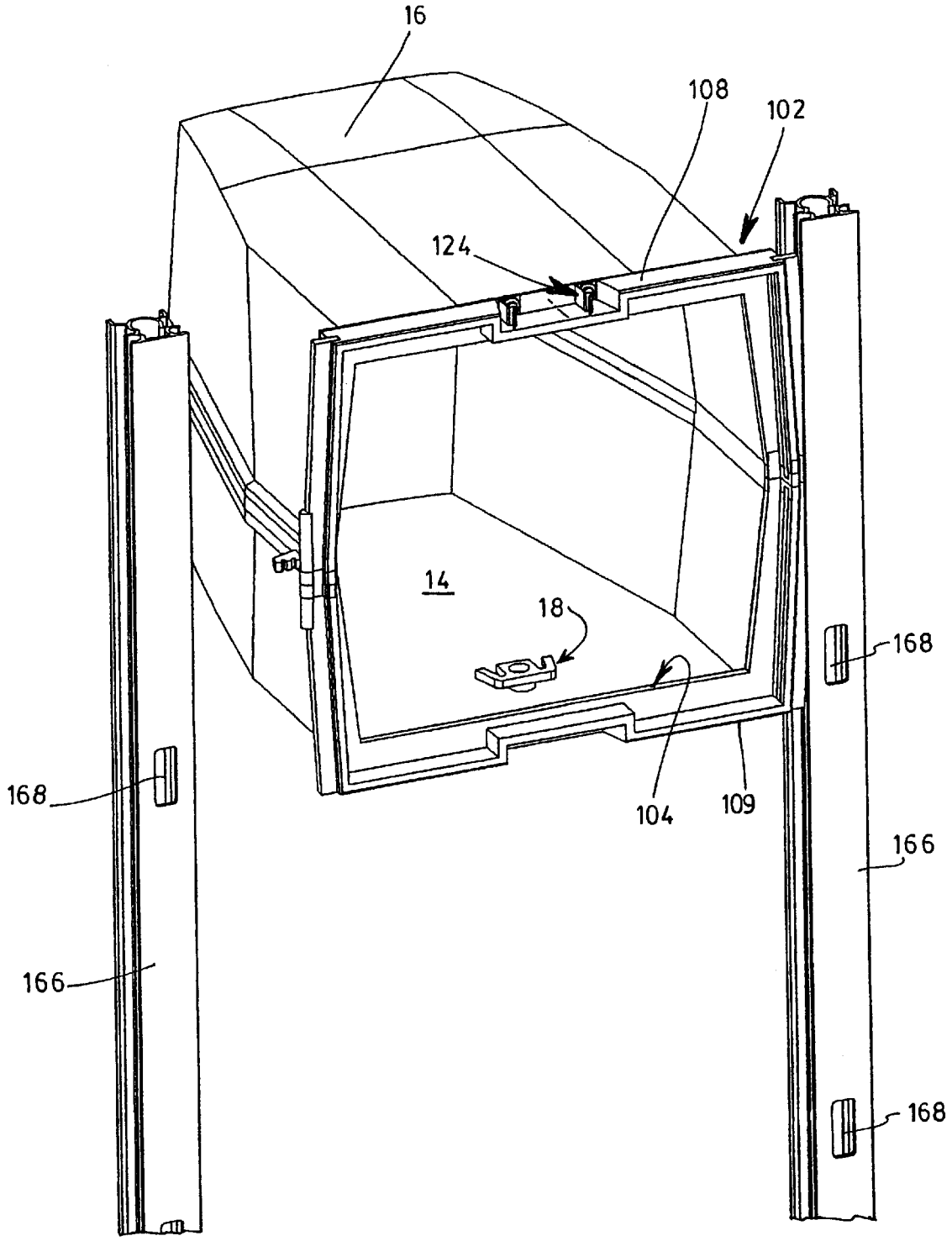
FIG. 4 is a perspective view of a columbarium niche provided with an urn locking mechanism and the resilient member of a shutter system according to various aspects of the present invention.

Preferably, the shutter system according to the invention is used for a columbarium niche 16 mounted on a pair of vertical side rails 166 extending on either sides thereof, as shown in FIG. 4. The vertical side rails 166 are each provided with hook-receiving slots 168 therein. In this embodiment, two hooks 170 project downwardly from opposite side ends 172 of the second bracket 146, to be engaged in the hook-receiving slots 168 to mount the frame 120 and thus the panel 110, on the columbarium niche 16. In this manner, the lateral movement of both the niches and the shutter panels is prevented.

The shutter system 100 also includes a hooking member 122 connected to the frame 120, and projecting away from the back face 114 of the shutter panel 110. The hooking member 122 is disposed near one of the edges of the shutter panel 110, preferably the top edge 118, and extends in a plane which is generally perpendicular to the back face 114 of the shutter panel 110 and generally parallel to its top edge 118 (or another edge that the hooking member is placed near to). The hooking member 122 may be punched out of the first bracket 142 and therefore be integral thereto.

Referring more particularly to FIG. 6, a resilient member 124 is also provided in the present shutter system to engage the hooking member 122 of the frame 120. The resilient member 124 is affixable to one of the sides of the rim 102 which corresponds to the edge of the frame 120 that the hooking member is proximate to. In the preferred embodiment, the resilient member is therefore affixed to the top side 108 of the rim 102. Once affixed, the resilient member protrudes outwardly from the top side 108 of the rim 102.

In the preferred embodiment, the hooking member 122 has an L-shaped portion 126 extending in the plane defined above, which has a free segment 127 (indicated in FIG. 5D) in a direction substantially parallel to the top edge 118 of the panel 110. The resilient member 124 preferably has a base 128 securable to the top side 108 of the rim 102, and a projection 130 shaped for releasably engaging with the L-shaped portion 126 of the hooking member 122. The projection 130 has three segments, that is, a flexible segment 132 projecting from the base 128, a hooking segment 134 at the end of the flexible segment 132 and substantially perpendicular thereto, and a slanted segment 136 slanting outwardly from the hooking segment 134, and forming an acute angle therewith. The flexible segment 132 has an original position where it is relaxed and an open position where it is bent laterally.

In the embodiment described above, to engage the resilient member 124 with the hooking member 122, the free segment 127 of the L-shaped portion 126 of the hooking member 122, first exercises a pressure on the slanted segment 136 of the projection 130, to move the flexible segment 132 from its original position to the open position. The free segment 127 then slides onto the slanted segment 136 until it reaches the hooking segment 134, and slips behind it. The flexible segment 132 is then free to return to its original position, and the hooking member 122 is thus engaged with the resilient member 124, as shown in FIG. 7.

Figure 7:
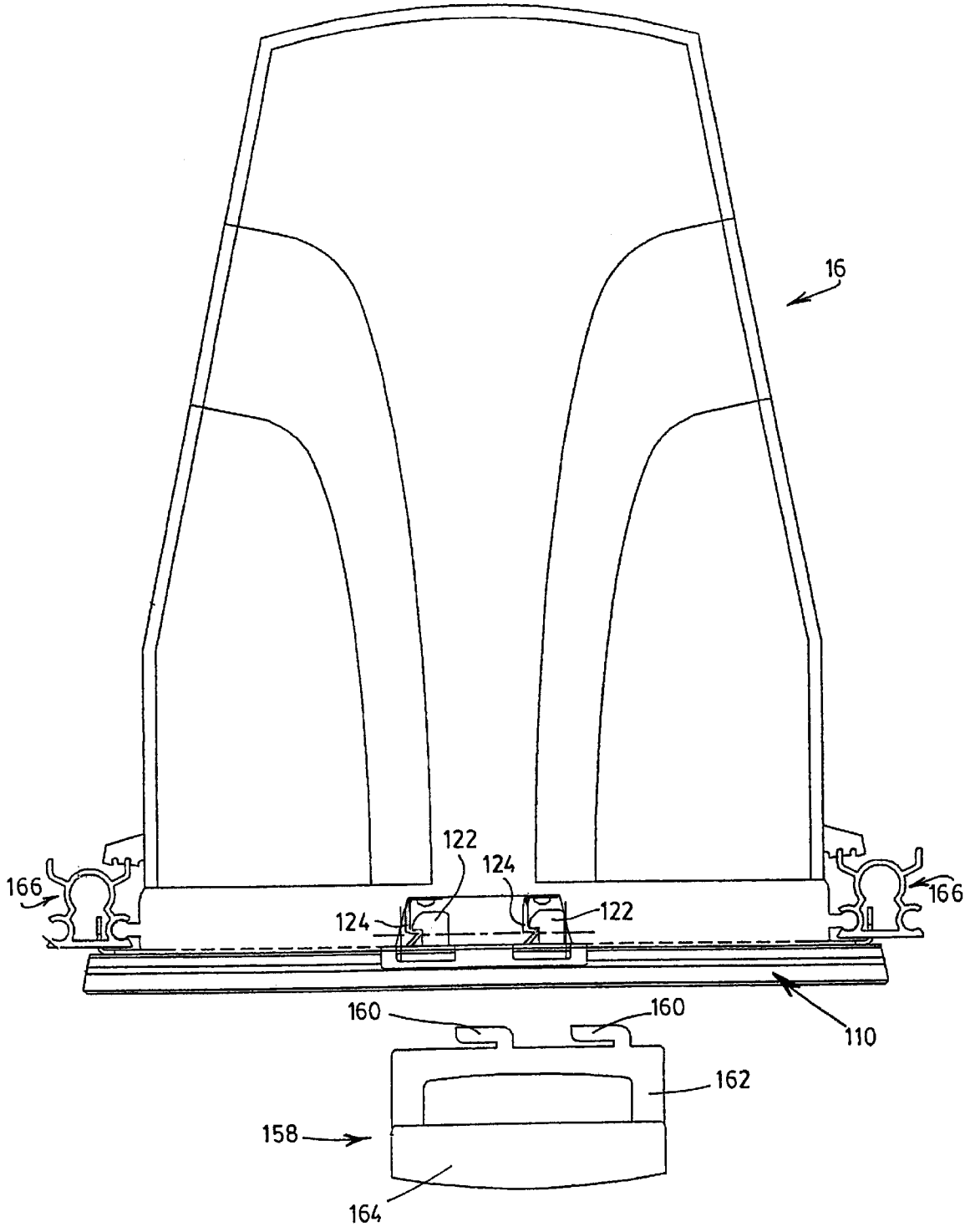
FIG. 7 is a top view in partial transparency of the shutter system of FIG. 6, when closed.

Referring to FIG. 7, to disengage the hooking member 122 from the resilient member 124, a key 158 is provided, preferably having an L-shaped tab 160 for laterally pushing the projection 130 of the resilient member 124, thereby disengaging the hooking member 122 therefrom. The key 158 also preferably includes a guide 162 for carrying the L-shaped tab 160 to the resilient member 124, and a handle 164 connected to the guide 162. Also preferably, the key 158 including all its components, is punched out of a single piece of metal.

Preferably, a protection post 123 is provided extending upwardly from the top edge 118 of the shutter panel 110, in alignment with the hooking member 122. The protection post 123 makes it difficult to access the resilient member and hooking member from the outside without a proper key.

As may be seen on the appended drawings, two hooking members 122 may be provided in a shutter system according to the invention, without departing from its scope. Of course, in this case, two resilient members 124 are correspondingly provided. The additional hooking member and resilient member may be similar to those described above.

Advantageously, the shutter system as described above, provides a lock on the shutter panel that is invisible from outside, and therefore does not ruin the solemn appearance of the columbarium or masauleum. Preferably, niches are mounted in such a manner that only a small distance is left between adjoining shutter panels, adapted to receive the key therein but making it difficult to unlock the system with another object.

The shutter system according to the present invention may be used with shutter panels made from a multitude of material. For example, the present invention would be especially well adapted for use with slabs of marble or granite known in the art, but other materials such as plastic or metal may easily be considered.

Of course, numerous changes could be made to the preferred embodiments disclosed hereinabove without departing from the scope of the invention as defined in the appended claims.

What is claimed is:

1. A shutter system for a funeral chamber, the funeral chamber having a rim outlining a substantially rectangular front opening, the rim comprising two pairs of opposite sides, the shutter system comprising:

a shutter panel for covering the front opening, the panel having a front face, a back face and two pairs of opposite edges, wherein one of said pairs of opposite edges consists respectively of a top edge and a bottom edge, and the other pair consists of two lateral edges, and wherein the back face has a first groove formed in the top edge and a second groove formed in the bottom edge;

mounting means for mounting the shutter panel to the funeral chamber, the mounting means including a frame connected to the back face of the shutter panel, and a hooking member connected to the frame, said hooking member projecting away from the back face of the shutter panel and proximate to the top edge of the shutter panel, the hooking member extending in a plane generally perpendicular to said back face and generally parallel to said one of the edges of the shutter panel, and wherein the frame comprises:

a first bracket with a tab insertable in the first groove;

a second bracket with a tab insertable in the second groove; and connecting means for removably connecting the first bracket to the second bracket and bringing them closer to clamp the panel between said tabs;

a resilient member affixable to one of said sides of the rim and protruding outwardly therefrom once affixed, said resilient member being engageable with the hooking member of the frame; and a key shaped to disengage the hooking member from the resilient member.

2. A shutter system according to claim 1, wherein the hooking member has an L-shaped portion extending in said plane and the resilient member has a base securable to said one side of the rim and a projection shaped for releasably engaging with the L-shaped portion of the hooking member.

3. A shutter system according to claim 2, wherein:

the projection comprises, outwardly from the base of the resilient member:

a flexible segment having an original position where it is relaxed and an open position where it is bent laterally;

a hooking segment substantially perpendicular to said flexible segment; and a slanted segment slanting outwardly from the hooking segment and forming an acute angle therewith; and the L-shaped portion of the hooking member has a free segment extending in a direction substantially parallel to said one of the edges of the panel;

whereby, to engage the resilient member with the hooking member, said free segment of the L-shaped portion of the hooking member exercises a pressure on the slanted segment of the projection to move the flexible segment from the original position to the open position, said free segment of the L-shaped portion then sliding onto the slanted segment until it reaches the hooking segment and slipping behind said hooking segment, the flexible segment then returning to its original position, thereby engaging the hooking member therewith.

4. A shutter system according to claim 2, wherein the key comprises:

an L-shaped tab for laterally pushing the projection of the resilient member to disengage the hooking member therefrom;

a guide for carrying the L-shaped tab to the resilient member; and a handle connected to the guide.

5. A shutter system according to claim 4, wherein the key is punched out of a single piece of metal.

6. A shutter system according to claim 1, wherein the connecting means for removably connecting the first bracket to the second bracket comprise nuts and bolts.

7. A shutter system according to claim 6, wherein:

the first bracket extends longitudinally on the back face of the panel from the top edge thereof towards the bottom edge, the first bracket having a top end provided with the tab, and a bottom end connectable to the second bracket; and the second bracket extends transversally along the bottom edge of the panel, the second bracket having a top end connectable with the bottom end of the first bracket, and a bottom end provided with the tab.

8. A shutter system according to claim 7, wherein the hooking member is integral to the top end of the first bracket.

9. A shutter system according to claim 8, wherein the hooking member is punched into the top end of the first bracket.

10. A shutter system according to claim 1, wherein the first and second brackets are made of metal.

11. A shutter system according to claim 10, said shutter system being for a funeral chamber mounted onto a pair of vertical side rails extending on either side thereof, said vertical side rails each having hook-receiving slots therein, wherein the mounting means for mounting the shutter panel to the funeral chamber comprise two hooks projecting downwardly from opposite side ends of the second bracket, said hooks being engageable with the hook-receiving slots.

12. A shutter system according to claim 1, wherein the mounting means of the frame comprise two of said hooking member, the shutter system comprises two of said resilient member, one of which is engageable with one of said hooking members and the other one being engageable with the other hooking member and the key being adapted to concurrently disengage both hooking members from the respective resilient member.

13. A shutter system according to claim 12, wherein:

the hooking members each have an L-shaped portion extending in said plane and having a free segment extending in a direction substantially parallel to the edges of the panel;

the resilient members each have a base securable to said one side of the rim and a projection shaped for releasably engaging with the L-shaped portion of said one of said hooking members, the projection comprises, outwardly from the base of the resilient member:

a flexible segment having an original position where it is relaxed and an open position where it is bent laterally;

a hooking segment substantially perpendicular to said flexible segment; and a slanted segment slanting outwardly from the hooking segment and forming an acute angle therewith; and the L-shaped portion of the hooking member has a free segment extending in a direction substantially parallel to said one of the edges of the panel;

whereby, to engage each of the resilient members with a corresponding one of the hooking members, said free segment of the L-shaped portion of the hooking member exercises a pressure on the slanted segment to move the flexible segment of the projection from the original position to the open position, said free segment then sliding onto the slanted segment until it reaches the hooking segment and slipping behind said hooking segment, the projection then returning to its original position, thereby engaging the hooking member therewith.

14. A shutter system according to claim 13, wherein the key is punched out of a single piece of metal, and comprises:

an L-shaped tab for laterally pushing the projection of the resilient member to disengage the hooking member therefrom;

a guide for carrying the L-shaped tab to the resilient member; and a handle connected to the guide.

15. A shutter system according to claim 14, wherein:

one of said pairs of opposite edges of the shutter panel consists respectively of a top edge and a bottom edge and the other pair consists of two lateral edges, the hooking members being located proximate to the top edge, and the back face of the shutter panel having a first groove formed in the top edge and a second groove formed in the bottom edge; and wherein the frame comprises:

a first metal bracket with a tab insertable into the first groove, said first bracket extending longitudinally on the back face of the panel from the top edge thereof towards the bottom edge, the first bracket having a top end provided with the tab and a bottom end, the hooking members being punched into the top end;

a second metal bracket with a tab insertable into the second groove, said second bracket extending transversally along the bottom edge of the panel, the second bracket having a top side connectable with the bottom end of the first bracket and bottom side provided with the tab; and nuts and bolts for removably connecting the first bracket to the second bracket and bringing them closer so as to clamp the panel between said tabs.

* * * * *